US006227278B1

(12) United States Patent
Forsland

(10) Patent No.: US 6,227,278 B1
(45) **Date of Patent: *May 8, 2001**

(54) SWING DOOR AND ROLL-UP DOOR WITH PLURAL DOOR FACADE

(76) Inventor: Kent H. Forsland, 283 Troy St., River Falls, WI (US) 54022

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/035,741

(22) Filed: Mar. 5, 1998

Related U.S. Application Data

(60) Provisional application No. 60/040,403, filed on Mar. 11, 1997.

(51) Int. Cl.[7] ..... A47H 1/00

(52) U.S. Cl. ..... 160/107; 160/113; 160/116; 160/201; 49/169

(58) Field of Search ..... 160/89, 92, 95, 160/97, 113, 115, 116, 118, 127, 107, 133, 179, 180, 201; 49/169

(56) References Cited

U.S. PATENT DOCUMENTS

| | | | | |
|---|---|---|---|---|
| 1,784,292 | * | 12/1930 | Johnson | 160/113 |
| 1,922,370 | * | 8/1933 | Johnson et al. | 160/201 |
| 1,989,658 | * | 1/1935 | McCloud | 160/116 |
| 2,017,012 | * | 10/1935 | Morgan | 160/116 |
| 2,023,691 | * | 12/1935 | McCloud | 49/169 |
| 2,759,227 | * | 8/1956 | Reid et al. | 160/116 |
| 2,861,836 | * | 11/1958 | Goeggel | 160/201 |
| 2,951,533 | * | 9/1960 | Lucas et al. | 160/201 |
| 3,003,200 | * | 10/1961 | Hansen | 160/90 |
| 3,078,917 | * | 2/1963 | Recchione | 160/113 X |
| 3,118,189 | * | 1/1964 | Dugger | 49/169 |
| 3,135,544 | * | 6/1964 | Mickey et al. | 160/113 |
| 3,217,784 | * | 11/1965 | Wolf et al. | 160/113 |
| 5,163,493 | * | 11/1992 | Kraeutler | 160/201 |
| 5,341,597 | * | 8/1994 | Stoltenberg | 49/28 X |
| 5,577,541 | * | 11/1996 | McKeon | 160/116 X |
| 5,848,630 | * | 12/1998 | Manzo | 160/113 |

* cited by examiner

*Primary Examiner*—Daniel P. Stodola
*Assistant Examiner*—Bruce A. Lev
(74) *Attorney, Agent, or Firm*—Burd, Bartz & Gutenkauf

(57) ABSTRACT

A combined swing door and roll-up door having upright front frame members projected outwardly from sheet members to provide a front facade of a plurality of swing doors. The sheet members have vertical grooves in their exterior surfaces extend generally parallel to the upright frame members.

19 Claims, 4 Drawing Sheets

SWING DOOR AND ROLL-UP DOOR WITH PLURAL DOOR FACADE

CROSS REFERENCE TO RELATED APPLICATIONS

This application claims benefit of U.S. Provisional Application No. 60/040,403, filed Mar. 11, 1997.

FIELD OF THE INVENTION

The invention relates to doors used to selectively open and close openings in structures. The doors include swing doors and roll-up garage doors used with buildings having doorways located in a vertical position to close the doorway and a horizontal position to open the doorway.

BACKGROUND OF THE INVENTION

Garage doorways in antiquated garages are closed with swinging doors attached to upright supports with hinges. These doors must be moved outwardly to open the doorway. The swinging doors require ground and head clearances to allow the doors to open and close. The designs of the swinging doors are having an architectural renaissance. In order to obviate the clearance requirements of the swinging doors, laterally roll open doors were developed. The roll open doors have a number of vertical sections hinged together in side-by-side relation. The doors are supported on right angle tracks for movement along the tracks between a closed position and an open position. The tracks are mounted on headers above the doorways and side supports extended inwardly from one side of vehicles in the garages. This makes it difficult to access and egress from the side of the vehicles adjacent the open doors. This problem was overcome with roll-up overhead doors. The roll-up overhead doors have horizontal panels that are hinged together. Rollers mount the panels on side tracks having vertical and horizontal sections to locate the door in a vertical closed position and an overhead horizontal position. The roll-up doors must be opened to allow a person to enter and exit the building.

SUMMARY OF THE INVENTION

The invention relates to a combined swing door and roll-up overhead door having a plurality of transverse panels for closing a doorway in a structure, such as a garage. Adjacent panels are connected with hinges to allow the door to articulate from a vertical position to a horizontal position as it moves along the side tracks which support the door adjacent a doorway. A border frame mounted on the front of the panels has openings accommodating a door facade. The frame has upright side and middle members and a transverse top member joined to the side members providing an outline of a doorway for the door facade. The swing door located adjacent one side of the roll-up door permits entrance and exit of a person from the building without opening the roll-up door.

An embodiment of the roll-up overhead door has a plurality of transverse panels comprising a top panel, a bottom panel, and intermediate panels. Hinges connect adjacent panels to allow the door to articulate from a vertical position to a horizontal position as it moves along side tracks which support the door adjacent a doorway. Each panel has framework to cover the inside of the framework. An outside wall of each panel includes sheet members attached to the framework to cover the outside of the framework. The outside sheet members are two or more one-piece wood sheet materials, such as exterior cedar plywood. The lower edges of the outside sheet members overlap an upper portion of the framework of an adjacent panel to provide a stepped interface between adjacent panel which inhibits the flow of wind, dust, water, and snow through the door. A border frame attached to the outside of the panels sets out openings that simulate side-by-side doorways. A swinging double door facade is imparted on the panel sections between the side and center border frame members. The roll-up door the center border frame has an upwardly curved or arched shape. The swinging door facade has arched windows located below arch of the top border frame. The sheet members of the outside walls of the panels are located below the windows. The swing door has a size, shape and configuration that follows a vertical section of the roll-up door to provide a four swing door facade.

DESCRIPTION OF PREFERRED EMBODIMENT

Figure 1:
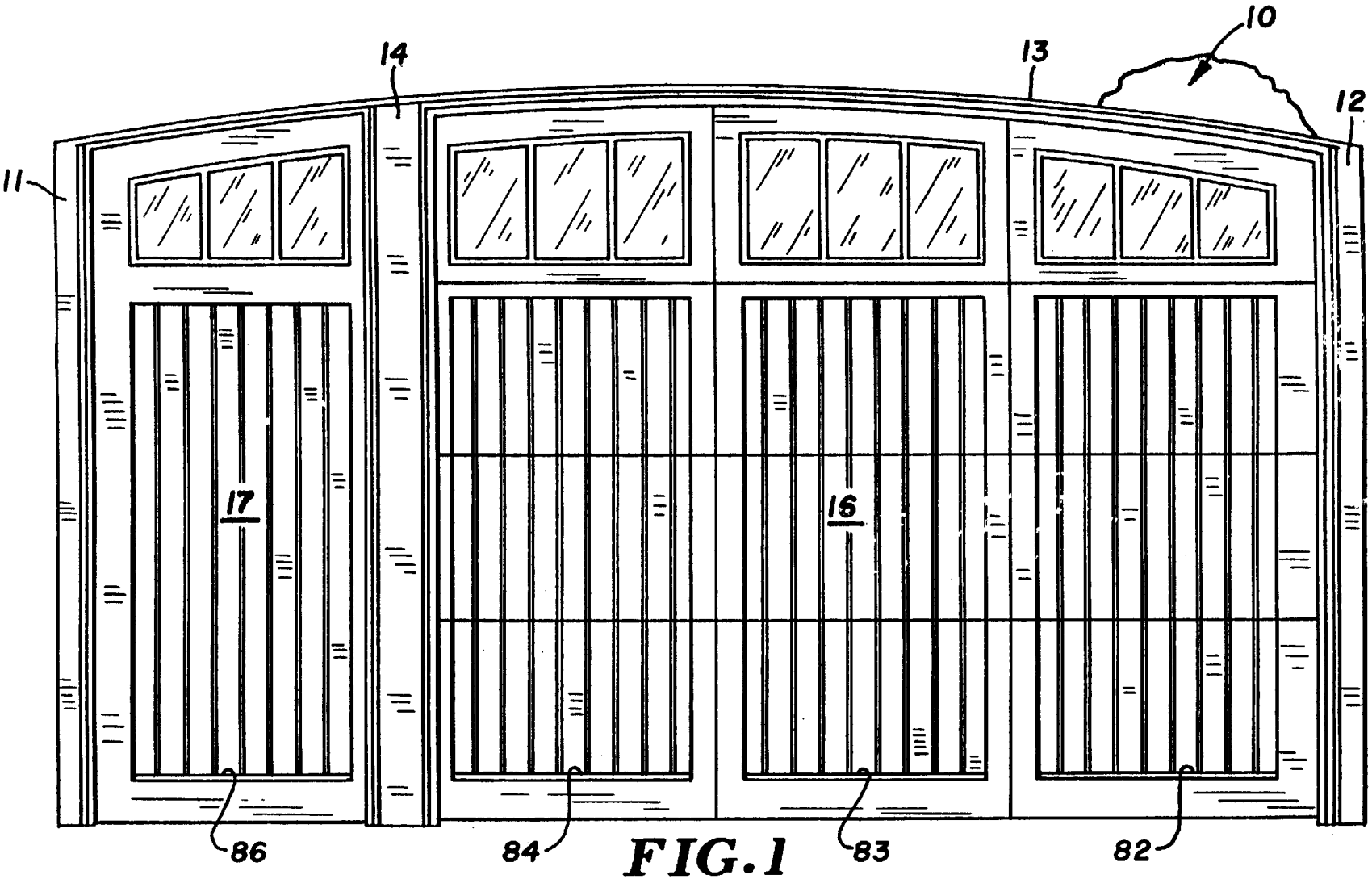
FIG. 1 is a front elevational view of the combined roll-up door any side hinged door installed in a building wall.

Referring to FIG. 1, a building 10 such as a vehicle garage, has a vertical wall having a doorway or opening defined by a door frame shown as upright side support members 11 and 12 and an arched header 13. An upright post 14 separates a roll-up door 16 and a side hinged door 17. The roll-up door 16 has an outside facade with a configuration and shape of three swinging doors. Each swinging door size, configuration and shape is substantially the same as the size, shape and configuration of the side hinged door 17. The entire closure for the doorway comprising doors 16 and 17 has a four lateral folding door facade. The door facade has symmetrical and balanced structure that blends doors 16 and 17 to provide a common door architectural work.

Figure 2:
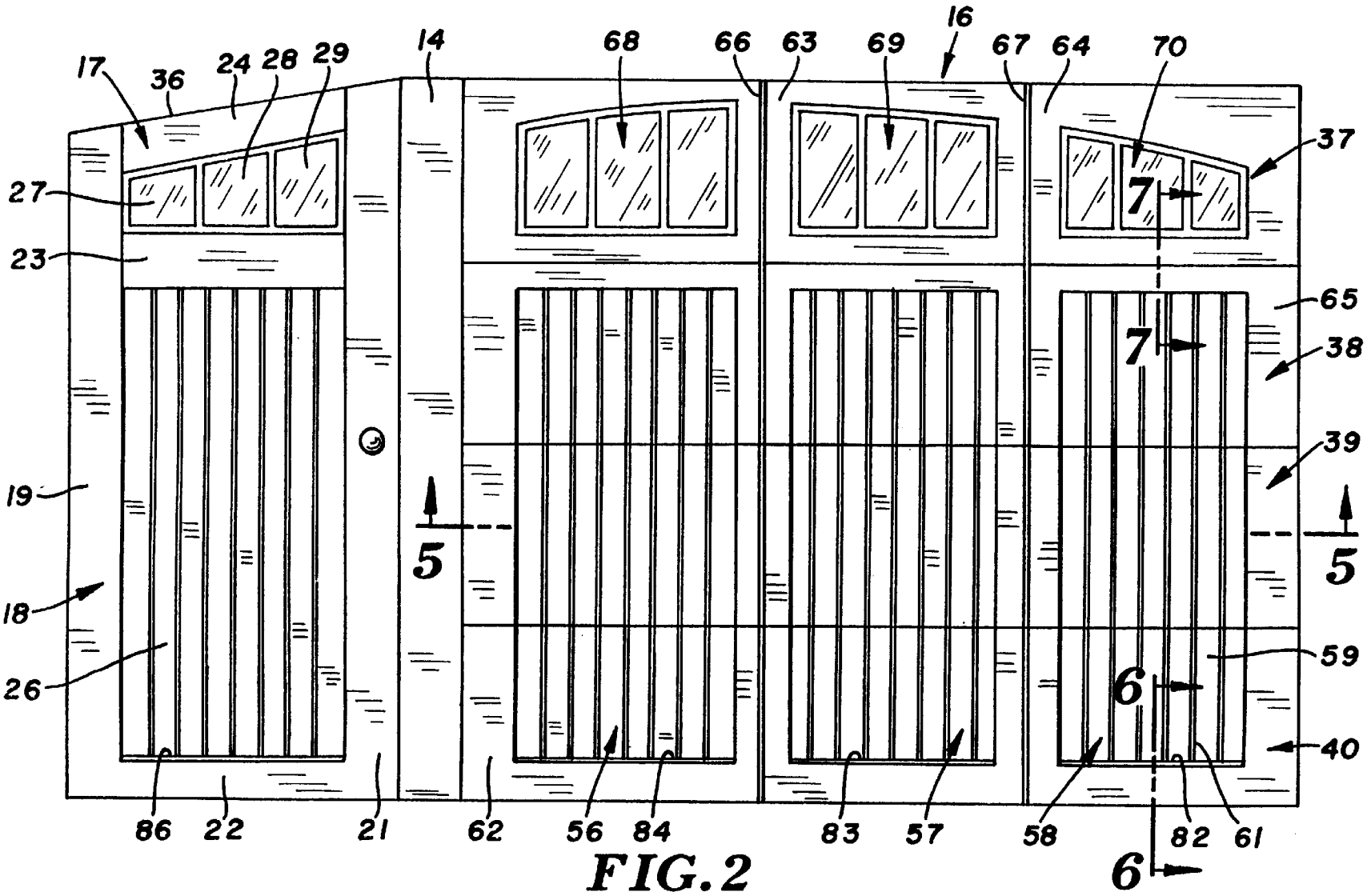
FIG. 2 is a front elevational view of the doors of FIG. 1.
Figure 4:
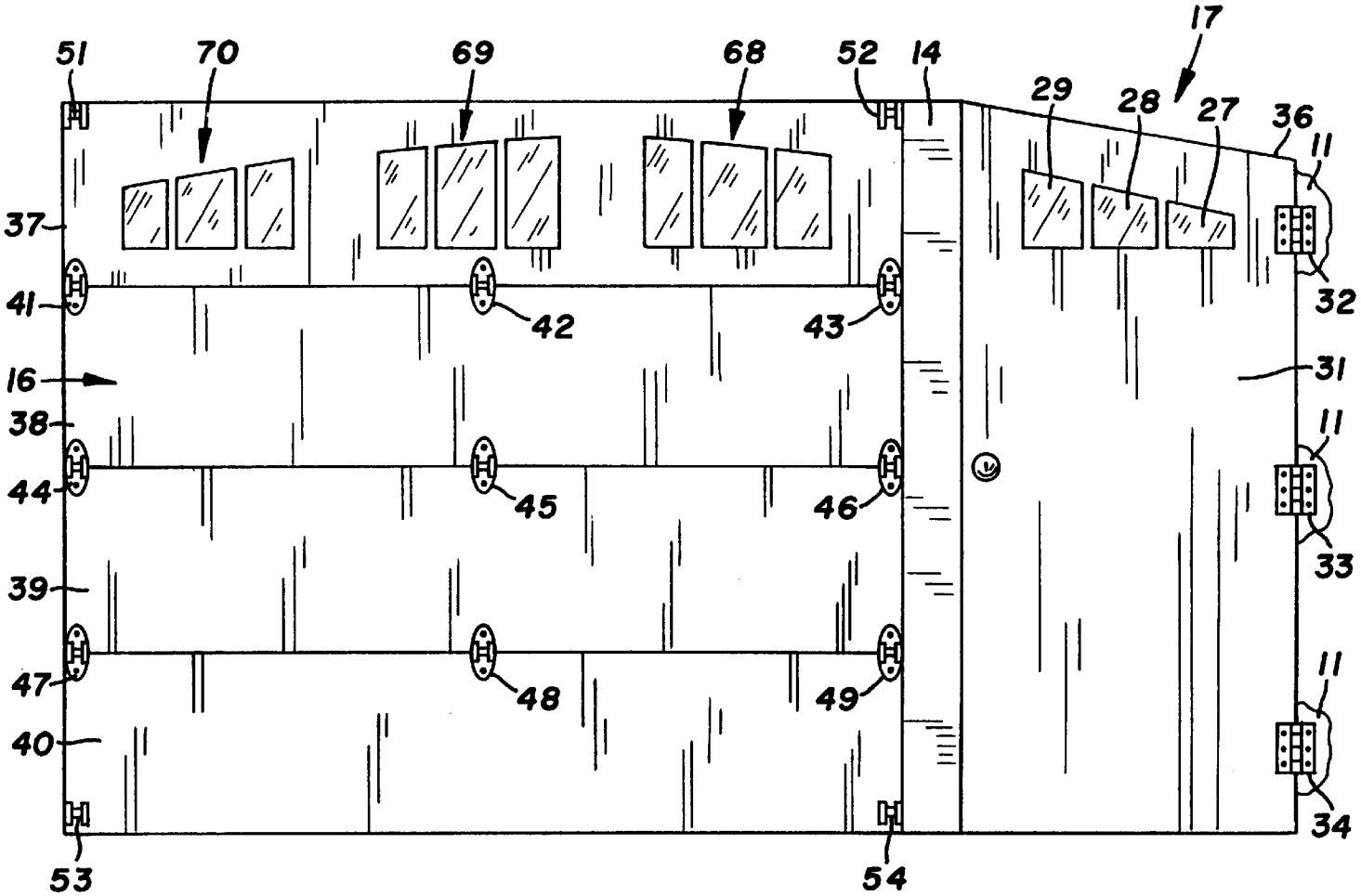
FIG. 4 is a rear elevational view of the doors of FIG. 5.
Figure 3:
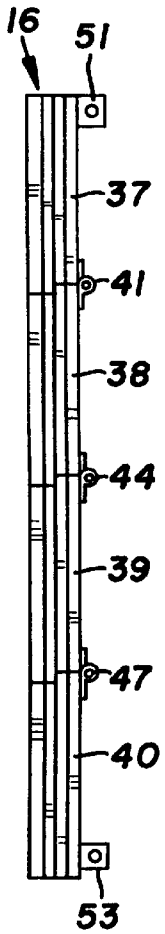
FIG. 3 is a side elevational view of the roll-up door of FIG. 2.

As shown in FIG. 2, door 17 has an outside frame 18 comprising upright side members 19 and 21 joined with cross members 22, 23 and 24. A grooved sheet member 26, such as exterior plywood siding, is surrounded by members 19, 21, 22 and 23. A set of windows 27, 28 and 29 are located between cross members 23 and 24. The back of door 17 has a back panel 31, shown in FIG. 4. Hinges 32, 33 and 34 pivotally mount door 17 on side support member 11 of the door frame. The top 36 of door 17 slants downwardly and outwardly to conform to the arch of header 13 and the shape of door 16.

Door 16 has four side-by-side horizontal sections or panels 37, 38, 39 and 40. Adjacent panels are hinged together with hinges 41–49 to allow adjacent panels to articulate relative to each other as the door is moved from the vertical closed position to the horizontal open position along rails (not shown). Brackets 51, 52 on top panel 37 and brackets 53 and 54 on bottom panel support rollers (not shown) that ride on the rails. Hinges 41, 44, 47 and 43, 46 and 49 also support rollers that ride on the rails. The hinges and rollers are conventional roll-up door structures.

As shown in FIG. 2, door 16 has three sections 56, 57 and 58 that simulate the size, configuration and shape of the front of door 17. Each section has a sheet member 59 having a plurality of vertical side by side grooves 61. Tongue and groove boards can by used in lieu of sheet member 59. Frame members 62, 63, 64 and 65 are located over the outside of sheet member 59. Frame members 63 and 64 have vertical grooves 66 and 67 which emphasize the three door facade of door 16. The top panel 37 has three sets of windows 68, 69 and 70. Each set of windows 68–70 has three transparent panes. Sets of windows 68 and 69 are mirror images of each other. Set of windows 70 is a mirror image of windows 27, 28 and 29 in door 17. The coordinated shapes and arrangement of the windows 68, 69 and 70 and windows 27–29 enhance the four door facade of the closure for the door way.

Figure 5:
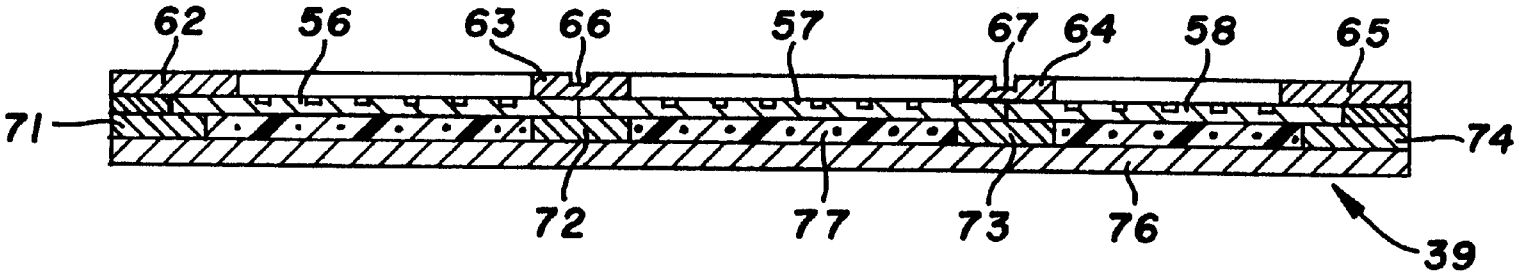
FIG. 5 is a sectional view taken along the line 5—5 of FIG. 2.

As shown in FIG. 5, door 16 has internal frame members 71, 72, 73 and 74. A back panel 76 closes the back of each door section. The sheet members 56, 57 and 58 are secured to the outside of frame members 71–74. A core 77 of heat insulation material, such as foam plastic, is located between panel 76 and sheet members 56–58. Outside members 62, 63, 64 and 65 connected to the frame members 71–74 locate sheet members 56–58 in rectangular recesses.

Figure 6:
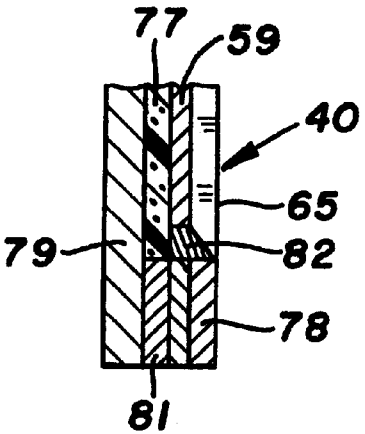
FIG. 6 is a sectional view taken along line 6—6 of FIG. 2.

As shown in FIGS. 2 and 6, door 16 has a front bottom member 78 and a back panel 79. Member 78 abuts the bottom of sheet member 59 to hold it against bottom frame member 81. A triangular corner member 82 located on top of member 78 is secured to frame member 81. Member 82 diverts rain, snow, and water away from the bottom of door 16 and prevent moisture from sweeping into the door. Corner members 83 and 84 are located adjacent the bottoms of shut members 56 and 57. A corner member 86 is located adjacent the bottom of sheet member 26 and door 17.

Figure 7:
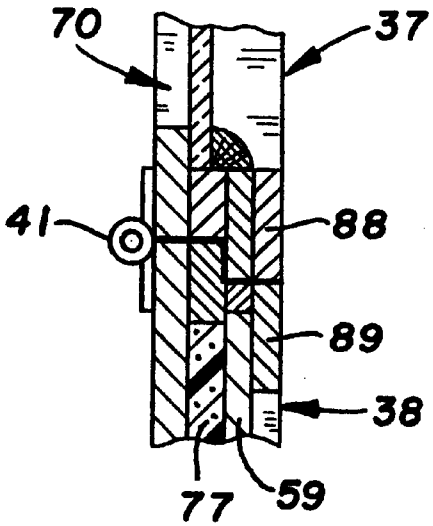
FIG. 7 is a sectional view taken along the line 7—7 of FIG. 2.

As shown in FIG. 7, stepped horizontal frame members 88 and 89 extend horizontally along adjacent portions of panels 37 and 38. When door 16 is closed adjacent stepped interface or surfaces of frame members 88 and 89 are in surface engagement thereby limiting the flow of air through door 16 and preventing the sweepage of water through door 16.

While there has been shown and described an embodiment of the combined doors of the invention, it is understood that changes and modifications in structure, material, arrangement or structures and materials may be made by those skilled in the art without departing from the invention.

I claim:

1. A combination of a swing door and roll-up door having a combined front facade having the appearance of a plurality of upright swing doors for closing a first opening and a second opening in a door frame having first and second upright side support members and a header extended between said first and second upright side support members comprising: an upright stationary post joined to the header separating the first and second openings, an upright swing door for closing the first opening located between the upright post and the first upright side support member, hinge means pivotally connecting the swing door to the first upright side support member of the door frame to allow the swing door to swing about an upright axis between open and closed positions relative to the first opening, said swing door having a front frame including upright members on opposite upright sides of the swing door and cross members extended between opposite ends of the upright members, said upright members being laterally spaced from each other, a sheet member located between the upright members having an upright exterior surface, said upright members extended outwardly from the upright exterior surface of the sheet member whereby the upright exterior surface is recessed relative to the upright members, a roll-up door for closing the second opening located between the upright post and the second upright side support member, said roll-up door having a plurality of horizontal panels, hinge means pivotally connecting adjacent panels to allow the panels to articulate relative to each other, said panels including horizontal sheet members having front sides, upright frame members located over the front sides of the panels and laterally spaced from each other a distance generally the same as the lateral distance between the upright members of the swing door whereby the fronts of the swing and roll-up doors have a combined facade of a plurality of upright swing doors.

2. The swing door and roll-up door of claim 1 wherein: the sheet member of the swing door and the horizontal sheet members of the roll-up door have vertical grooves in the exterior surface of sheet member and the front sides of the horizontal sheet members.

3. The swing door and roll-up door of claim 1 wherein: at least some of the upright members of the roll-up door have an exterior surface and a vertical groove in the exterior surface thereof to emphasize the front swing doors facade of the roll-up door.

4. The swing door and roll-up door of claim 1 wherein: the horizontal panels include a top panel and a plurality of swing windows located in the top panel, said first door having an upper portion, and second windows located in the upper portion of the swing door, said first and second windows have upper edges located along an upwardly convex curved line.

5. A combination of: a swing door and a roll-up door having a combined front facade having the appearance of a plurality of upright swing doors, a door frame having first and second side support members, a header extended between said first and second side support members and an upright stationary post separating first and second openings said swing door closing the first opening, hinge means for pivotally connecting the swing door to the first upright side support member of the door frame to allow the swing door to swing about an upright axis between open and closed positions relative to the first opening, said swing door having a front frame including upright members on opposite upright sides of the door, said upright members being laterally spaced from each other, a first wall located between the upright members having an upright exterior surface, said upright members extended outwardly from the upright exterior surface of the first wall whereby the upright exterior surface is recessed relative to the upright members, a said roll-up door closing the second opening located between the upright post and the second upright side support member, said roll-up door having a plurality of horizontal panels, hinge means pivotally connecting adjacent panels to allow the panels to articulate relative to each other, said panels including horizontal second walls having front sides, upright frame members located over the front sides of the panels, adjacent upright frame members being laterally spaced from each other a distance generally the same as the lateral space between the upright members of the first swing door whereby the fronts of the swing and roll-up doors have a combined facade of a plurality of upright swing doors.

6. The swing door and roll-up door of claim 5 wherein: the first wall of the swing door and the horizontal second walls of the roll-up door have vertical grooves in the exterior surfaces of the first walls and the front sides of the second walls.

7. The swing door and roll-up door of claim 5 wherein: at least some of the upright members of the roll-up door have exterior surfaces and a vertical groove in each of the exterior surfaces thereof to exphasize the front swing doors facade of the roll-up door.

8. The swing door and roll-up door of claim 5 wherein: the horizontal panels include a top panel and a plurality of first windows located in the top panel, said first door having an upper portion, and second windows located in the upper portion of the swing door, said first and second windows have upper edges located along an upwardly convex curved line.

9. A combination of: a swing door and a roll-up door having a combined front facade having the appearance of a plurality of upright swing doors, a door frame having first and second side support members and an upright stationary post separating first and second openings, an upright swing door having a width for closing the first opening, pivot means for connecting the swing door to the first side support member to allow the swing door to swing about an upright axis between open and closed positions relative to the first opening, a roll-up door for closing the second opening located between the upright post and second side support member, said roll-up door having a front, and adjacent upright frame members on the front of the roll-up door, said adjacent frame members being laterally spaced from each other a distance generally the same as the width of the swing door whereby the fronts of the swing and roll-up doors have a combined facade of a plurality of upright swing doors.

10. The swing door and roll-up door of claim 9 wherein: said swing door has an upright wall having a front with opposite sides and upright frame members located and on opposite sides of the front of the upright wall and projected outwardly from said wall.

11. The swing door and roll-up door of claim 9 wherein: said roll-up door has a plurality of horizontal panels, each panel having an upright wall means providing an exterior surface, said frame members of the roll-up door being mounted on the exterior surface of the wall means and projected outwardly from said exterior surfaces of the wall means, and pivot means connecting adjacent panels to allow the panels to articulate relative to each other.

12. The swing door and roll-up door of claim 11 wherein: the roll-up door has a top panel, a plurality of first windows mounted on said top panel, said swing door having an upper portion and at least one second window mounted on said upper portion of the swing door.

13. The swing door and roll-up door of claim 12 wherein: said first and second windows have upper edges located along an upwardly convex curved line.

14. The swing door and roll-up door of claim 9 wherein: said swing door has an upright wall with a first exterior surface and upright frame members mounted on the wall and projected outwardly from said first exterior surface, said roll-up door having wall means providing a second exterior surface, said upright members of the roll-up door projected outwardly from the second exterior surface.

15. The swing door and roll-up door of claim 14 including: upright grooves in said first and second exterior surfaces, said grooves extended generally parallel to the upright members on the wall and wall means.

16. The swing door and roll-up door of claim 9 wherein: exterior vertical groove means in at least some of the upright members on the front of the roll-up door to emphasize the front swing doors facade of the roll-up door.

17. The swing door and roll-up door of claim 9 wherein: the upright members of the roll-up door comprise upright first members located on opposite sides of the front of the roll-up door and a pair of second members located between the first members.

18. The swing door and roll-up door of claim 17 including: horizontal frame members on the roll up door adjacent upper and lower ends of the upright members.

19. The swing door and roll-up door of claim 17 including: vertical groove means in said pair of second members to exphasize the front swing door facade of the second door.

* * * * *